US005818720A

United States Patent [19]

Grigalunas

[11] Patent Number: 5,818,720

[45] Date of Patent: Oct. 6, 1998

[54] PROCESS FOR LARGE REPEAT FABRIC DESIGN AND WEAVING

[75] Inventor: Mark Grigalunas, New York, N.Y.

[73] Assignee: Sunbury Textile Mills, Inc., Sunbury, Pa.

[21] Appl. No.: 708,346

[22] Filed: Sep. 6, 1996

[51] Int. Cl.[6] ..... G06F 19/00

[52] U.S. Cl. ..... 364/470.11; 364/470.02; 364/470.04; 139/319

[58] Field of Search ..... 364/470.02–470.06, 364/470.11, 474.09, 474.13, 474.24; 382/111; 139/319; 112/475.05, 470.04

[56] References Cited

U.S. PATENT DOCUMENTS

| | | | |
|---|---|---|---|
| 3,671,944 | 6/1972 | Dubner | 340/172.5 |
| 3,744,035 | 7/1973 | Geirhos et al. | 340/172.5 |
| 4,120,045 | 10/1978 | Moellgaard et al. | 364/900 |
| 4,733,700 | 3/1988 | Griffith | 139/383 R |
| 4,807,143 | 2/1989 | Matsuura | 364/468 |
| 5,016,183 | 5/1991 | Shyong | 364/470 |
| 5,058,174 | 10/1991 | Carroll | 382/1 |
| 5,095,835 | 3/1992 | Jernigan et al. | 112/475.05 |
| 5,200,904 | 4/1993 | Tottman | 364/470 |
| 5,388,055 | 2/1995 | Tanizawa | 364/491 |
| 5,464,046 | 11/1995 | McIntyre | 139/455 |

FOREIGN PATENT DOCUMENTS

| | | | |
|---|---|---|---|
| 0129386 | 12/1984 | European Pat. Off. | D03D 49/60 |
| 0522216 | 1/1993 | European Pat. Off. | D03C 3/36 |
| 0678602 | 10/1995 | European Pat. Off. | D03C 3/20 |

OTHER PUBLICATIONS

*Designing and Equipment Requirements for Jacquard Weaving*, J. Robert Wagner, 1988.

*Primary Examiner*—Thomas C. Lee
*Assistant Examiner*—Steven R. Garland
*Attorney, Agent, or Firm*—Bell Seltzer Intellectual Property Group of Alston & Bird LLP

[57] ABSTRACT

A process of designing and weaving fabrics with pattern repeats over the full length of the fabric such as draperies or bedspreads. The pattern can incorporate one or more actual patterns within the repeat to reduce waste and inventory requirements for fabricators. The pattern repeat is typically incorporated into fabrics having a length greater than 50 inches. The design process is computer-aided to create an engineered repeat in the fabric panels which are then woven using an electronic weaving machine. Individual patterns are repeated across the width and length of the woven fabric.

11 Claims, 1 Drawing Sheet

PROCESS FOR LARGE REPEAT FABRIC DESIGN AND WEAVING

BACKGROUND OF THE INVENTION

I. Field of the Invention

This invention relates to a process for designing and weaving decorative patterns into a fabric, and, in particular, to a process of designing patterns which only repeat over long lengths of the fabric for drapery panels, bedspreads and the like.

II. Description of the Prior Art

While solid color fabrics are simpler to weave and print, consumers demand decorative patterns which typically bring more than one color to a fabric. In the typical fabric design, such patterns are created by repeating a geometrical pattern across the width of the fabric panel. Such pattern repeats work well for applications such as in upholstered furniture, pillows and in some instances clothing. Prior known repeat patterns include 27", 13.5", 6.75", 3.75" etc. square sections depending upon the specific pattern. There may be variations of these repeats across the width of a fabric but full length repeats have not heretofore been woven into a fabric. The design process used for large items such as draperies and bedspreads consists of producing both woven and printed fabrics in pattern repeat layouts in these well known dimensions.

The limited pattern repeat of prior technology has resulted in substantial waste of fabric to construct bedspreads and drapery panels as well as increased inventory requirements. The fabricator of bedspreads and draperies have had to combine two or more fabric panels in order to produce a bedspread or drape consisting of more than one pattern design. This results in carrying double or more inventory and significant waste when the fabrics are cut to match on the piece being produced.

SUMMARY OF THE PRESENT INVENTION

The present invention overcomes the disadvantages of the prior known fabric design and weaving processes by providing a computer-aided design process or creating fabric repeats extending the full length of the drape or bedspread and incorporates one or more patterns within the repeat.

The process begins with the selection of desired artwork, construction and weave for a large fabric panel such as a drapery panel. The overall panel is analyzed for specific pattern repeats which are isolated using a scanner which also enters the data of the scanned segment into the computer. This process is repeated for every different pattern of the complete panel. Each image is edited to improve resolution and color.

After all the images are edited, an empty image bed is created having the overall dimensions of the finished pattern. Each individual image is subsequently "pasted" to the overall image in the necessary repeat to create the panel. A first pattern image may be applied across the width of the panel. A second pattern image is repeated across the panel and subsequent rows of pattern repeats are applied to the image bed. Finally, a single repeat pattern is applied. This final pattern may overlap some of the repeat patterns and therefore editing of the overall image bed will be necessary. After all the images are pasted to the full panel, the selected weaves are applied using a computer software weave overlay program. The complete image panel is now complete for weaving into the drapery panel.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawings, in which like reference characters refer to like parts throughout the view and in which.

DETAILED DESCRIPTION OF A PREFERRED EMBODIMENT OF THE PRESENT INVENTION

Figure 1:
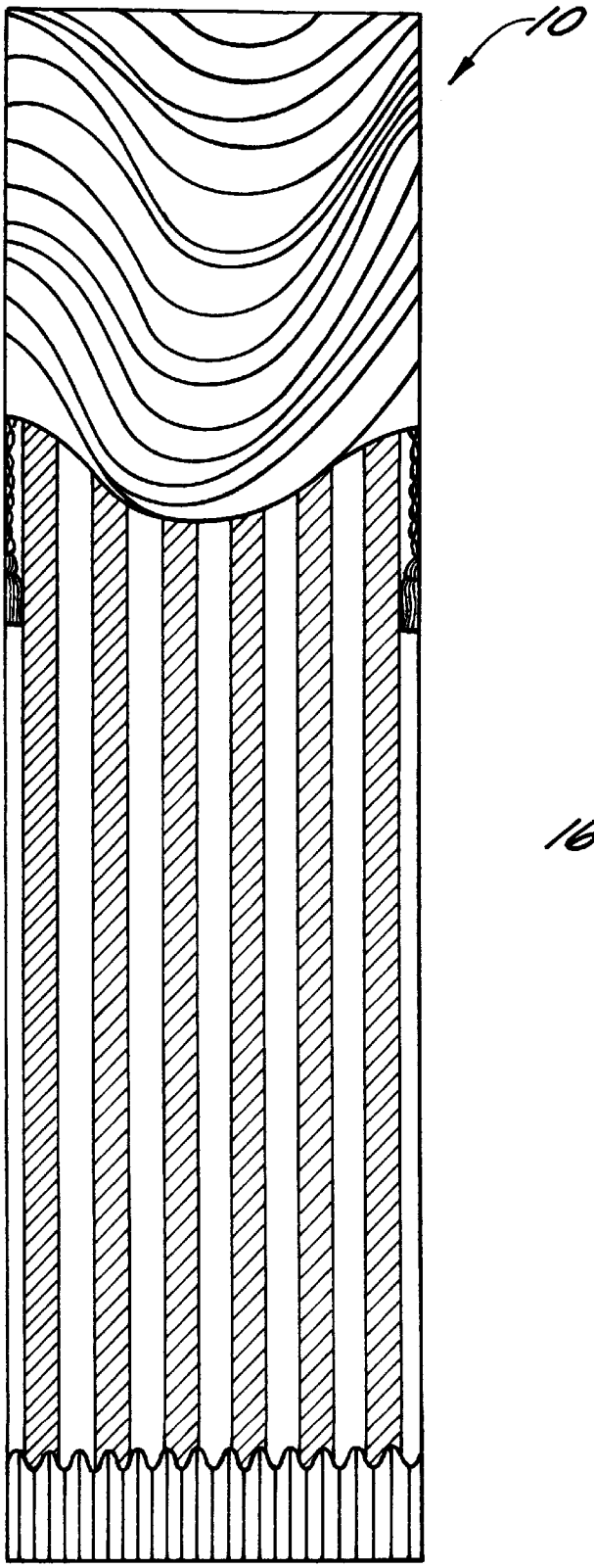
FIG. 1 is a face view of a complete pattern panel incorporating individual pattern segments.

Referring first to FIG. 1, there is shown a sample fabric panel 10 created using the process of the present invention. The illustrated panel 10 is intended to be used as a drapery panel although the process of the present invention may be utilized to create a variety of large repeat fabrics including bedspreads in order to reduce waste of material and inventory requirements. The panel 10 utilized as an example has a width of 13½ inches which is conventional for the industry but a length of 100 inches incorporating the pattern. The repeat on a fabric panel is measured both horizontally and vertically. In order to calculate cards and ends which are well known terms used in the weaving process, the horizontal width of 13½ inches is multiplied by 142.2 ends totalling 1920 ends ad the vertical length of 100 inches is multiplied by 32 px/inch to total 3200 cards for the complete woven pattern. However, as can be seen in FIG. 1, the complete panel 10 incorporates three distinct patterns formed by pasting individual pattern repeats onto the overall image as will be subsequently described.

Figure 2:
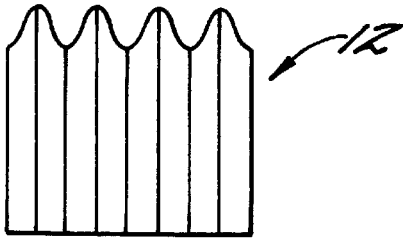
FIGS. 2 through 4 are individual pattern panels incorporated into the overall image.
Figure 3:
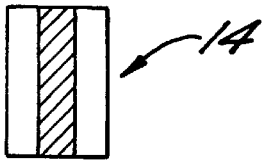
Figure 4:
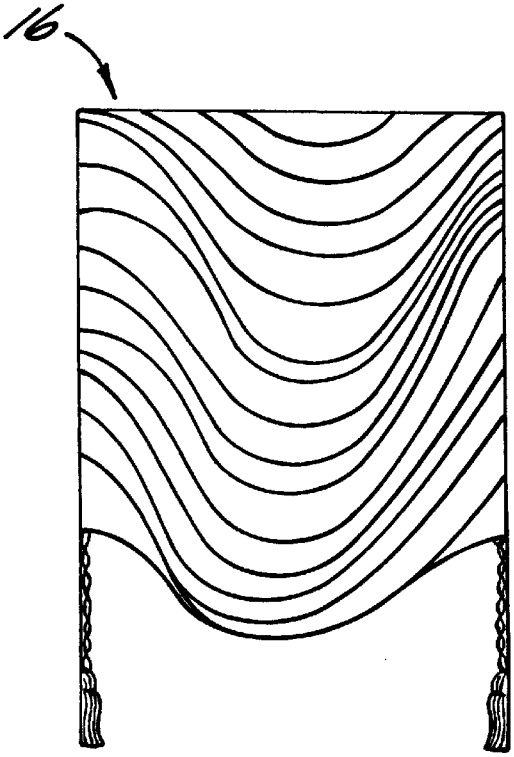

Referring now to FIGS. 1 through 4, the overall panel 10 is created with a repeat of a first image 12 shown in FIG. 2, a repeat of a second image 14 shown in FIG. 3 and a repeat of a third image 16 shown in FIG. 4. For the sake of clarity by way of a specific example, the first image 12 has a width of 6.75 inches or 960 ends and a length of 7.5 inches or 240 cards, and in this example is repeated twice across the bottom of the overall image 10. The second image 14 has a width of 2.25 inches or 320 ends and a length of 4 inches or 128 cards. The second image 14 is repeatedly applied both horizontally and vertically over the panel 10. The third image 16 has a width of 13.5 inches or 1920 ends and a length of 22 inches or 704 cards. This third image 16 will be applied once to the panel 10. These images and dimensions are provided as an example only for a clear understanding of the invention and other images and/or dimensions may be employed to create a large repeat fabric pattern.

Using the artwork developed for the finished product, individual repeats are isolated for scanning into memory such as in a computer. FIGS. 2 through 4 each represent the applicable repeat segments utilized to form the complete panel 10. The individual repeat segments are measured horizontally and vertically and then calculated into ends and cards based on a 960 hook loom. For example, the horizontal width of the first segment 12 is 6.75 inches and the vertical length is 7.5 inches. To calculate cards and ends, the horizontal width is multiplied by 142.2 ends which equals 960 ends and the vertical length is multiplied by 32 px/inch which equals 240 cards. In order to calculate the final number of cards, the weaves to be used must be calculated as well as the number of cards and ends in each weave. The final pattern 10 is 100 inches long. The weaves need to repeat into the total number of cards which is 3200 (32 px/inch×100 inches). In this pattern 10, the weaves being used all have a horizontal repeat of 8 to 16 ends and a vertical repeat of 8 to 16 cards.

These steps of isolation, characterization and scanning are carried out for each of the individual repeat segments 12, 14 and 16 of the full artwork which depicts the final panel 10. Following scanning of the individual segments into computer memory, the images are edited to perfect the image including color and resolution.

An empty image bed is created of sufficient size to accommodate the finished panel, in this example, 13½ inches or 1920 ends by 100 inches or 3200 cards. The individual scanned images 12, 14 and 16 may now be "pasted" to the overall image bed in the required repeat pattern to form the full image. In the described example, the first image 12 is pasted along the bottom using two end repeats to total 1920 ends. Thereafter, the second image 14 is pasted above the first image 12 using six end repeats and 24 card rows to the full length of the image bed. This creates the longitudinal stripes of the panel 10. Finally, the third image 16 is applied over the end of the image bed in a single repeat. Where the third image 16 meets the second image 14, some editing may be needed to perfect the image.

After all images are pasted to the image bed, the weaves are applied using a computer software weave overlay program. Weaves are locked off to prevent yarns from sliding. The computer can also be used to determine any filling or warp floats longer than a specified length. The image of the drapery panel 10 is now complete for the weaving process which utilizes the computer data to control the loom in weaving the drapery panel. Thus, while the prior known patterns plotted a single pattern across and along a fabric panel requiring the combining of different fabric panels to create a drapery or bedspread, the present invention facilitates plotting of a plurality of images onto an image bed for weaving by the loom into a complete fabric panel.

The foregoing detailed description has been given for clearness of understanding only and no unnecessary limitations should be understood therefrom as some modifications will be obvious to those skilled in the art without departing from the scope and spirit of the appended claims.

What is claimed is:

1. A process for creating a large repeat fabric pattern image having a predetermined width and a predetermined length, said large pattern image utilized for weaving a fabric panel with a large repeat decorative pattern, said process comprising the steps of:

creating an illustration of said large repeat pattern image;

isolating a plurality of image segments of said illustration, said image segments representing individual patterns thereof;

scanning said isolated image segments for storage into memory means;

plotting said isolated image segments on an image bed, at least one of said image segments plotted repeatedly across said image bed to create said large repeat fabric pattern image; and storing said plotted image bed into said memory means.

2. The process as defined in claim 1 and further comprising the step of inputting said plotted image bed into an electronic weaving loom for weaving of a fabric panel incorporating said large repeat fabric pattern image.

3. The process as defined in claim 2 wherein said step of isolating a plurality of image segments of said illustration includes determining an image of predetermined dimensions for plotting.

4. The process as defined in claim 3 wherein at least one of said image segments is repeatedly plotted across both the width and along a portion of the length of said image bed.

5. The process as defined in claim 4 wherein at least one of said image segments is plotted a single time on said image bed.

6. The process as defined in claim 1 wherein said plotting step is conducted for each of said plurality of isolated image segments to create said large repeat fabric pattern image.

7. A process for creating a large repeat fabric pattern image having a predetermined width and a predetermined length, said large pattern image utilized for weaving a fabric panel with a large repeat decorative pattern, said process comprising the steps of:

creating an illustration of said large repeat pattern image;

isolating a plurality of image segments of said illustration, said image segments representing independent patterns thereof;

scanning said isolated image segments for storage into memory means;

plotting said isolated image segments on an image bed, a first image segment plotted repeatedly across a width of said image bed and a second image segment plotted repeatedly across the width of said image bed and along at least a portion of the length of said image bed, said plotting creating said large repeat pattern image; and storing said plotted image bed into said memory means.

8. The process as defined in claim 7 and further comprising the step of inputting said plotted image bed into an electronic weaving loom for weaving of a fabric panel incorporating said large repeat fabric pattern image.

9. The process as defined in claim 8 wherein said step of isolating a plurality of image segments of said illustration includes determining an image of predetermined dimensions such that said image segments can be plotted in their entirety on said image bed.

10. The process as defined in claim 9 wherein at least one of said image segments is plotted a single time on said image bed.

11. The process as defined in claim 7 wherein said isolated image segments are scanned into computer memory.

* * * * *